US012584250B2

(12) United States Patent
Ferrigolo et al.

(10) Patent No.: US 12,584,250 B2
(45) Date of Patent: Mar. 24, 2026

(54) KNITTED ARTICLE, IN PARTICULAR FOR AN ORTHOPAEDIC BRACE

(71) Applicant: F.G.P. S.R.L., Villafranca di Verona (IT)

(72) Inventors: Moreno Ferrigolo, Verona (IT); Alberto Turrini, Verona (IT); Giacomo Zampini, Verona (IT); Gianfranco Rosignoli, Verona (IT)

(73) Assignee: F.G.P. S.R.L., Villafranca di Verona (IT)

( * ) Notice: Subject to any disclaimer, the term of this patent is extended or adjusted under 35 U.S.C. 154(b) by 0 days.

(21) Appl. No.: 18/988,364

(22) Filed: Dec. 19, 2024

(65) Prior Publication Data

US 2025/0207307 A1 Jun. 26, 2025

(30) Foreign Application Priority Data

Dec. 20, 2023 (EP) ..... 23218682

(51) Int. Cl.
*D04B 1/12* (2006.01)
*D04B 1/10* (2006.01)
*D04B 1/24* (2006.01)

(52) U.S. Cl.
CPC ..... *D04B 1/102* (2013.01); *D04B 1/12* (2013.01); *D04B 1/24* (2013.01)

(58) Field of Classification Search
CPC ..... D04B 1/102; D04B 1/12; D04B 1/123; D04B 1/16; D04B 1/24
See application file for complete search history.

(56) References Cited

U.S. PATENT DOCUMENTS 10,194,711 B2 * 2/2019 Dua ..... D04B 1/24
11,542,641 B2 * 1/2023 Atmanspacher ..... D04B 1/04
(Continued)

FOREIGN PATENT DOCUMENTS

CN 116670347 A * 8/2023
EP 0498062 A1 * 8/1992 ..... D04B 1/18
(Continued)

OTHER PUBLICATIONS

European Patent Office, Search Report and Written Opinion for Patent Application No. EP23 21 8682, Mar. 13, 2024, 9 pages, European Patent Office.

*Primary Examiner* — Danny Worrell
(74) *Attorney, Agent, or Firm* — FERENCE & ASSOCIATES LLC

(57) ABSTRACT

A knitted article 1, in particular for an orthopaedic brace, with a plurality of zones having different cushioning properties, including at least one flat-knitted zone 10 and at least one padded zone 20, comprises a lower layer 30 consisting of several rows of knitted stitches obtained by knitting a corresponding flat-knitted thread, an upper layer 40 consisting of several rows of knitted stitches obtained by knitting a corresponding flat-knitted thread, and a padding layer 50 obtained by a padding yarn different from the flat-knitted thread in that it comprises at least one bundle of padding threads. In particular, the flat-knitted zone 10 consists of the lower and upper layers 30, 40 connected to each other. The padded zone 20, on the other hand, consists of the padding layer 50 interposed between the lower and upper layers 30, 40, for that the padding yarn is laid in at least one row of knitted stitches of the lower and/or upper layer. The present invention also refers to a process for making a knitted article.

17 Claims, 5 Drawing Sheets

(56) References Cited

U.S. PATENT DOCUMENTS

| | | | | |
|---|---|---|---|---|
| 11,624,134 | B2 * | 4/2023 | Bartys | A43B 23/0205 36/84 |
| 12,016,430 | B2 * | 6/2024 | Siegismund | A43B 23/0215 |
| 2019/0037966 | A1 * | 2/2019 | Aceves Tinajero | D04B 1/24 |
| 2019/0116914 | A1 * | 4/2019 | Schoppel | A43B 1/04 |
| 2019/0313728 | A1 * | 10/2019 | Berrian | A43B 23/042 |
| 2020/0187595 | A1 * | 6/2020 | Siegismund | D04B 1/22 |
| 2021/0186156 | A1 * | 6/2021 | Pogl | D04B 1/102 |
| 2025/0207307 | A1 * | 6/2025 | Ferrigolo | D04B 1/24 |

FOREIGN PATENT DOCUMENTS

| | | | | |
|---|---|---|---|---|
| EP | 2436276 | A1 * | 4/2012 | D04B 1/265 |
| EP | 3123989 | A1 | 2/2017 | |
| EP | 3480350 | A1 | 5/2019 | |
| EP | 3839116 | A1 | 6/2021 | |
| GB | 2473321 | A * | 3/2011 | D04B 1/18 |
| WO | WO2019079554 | A1 | 4/2019 | |

* cited by examiner

KNITTED ARTICLE, IN PARTICULAR FOR AN ORTHOPAEDIC BRACE

CROSS-REFERENCE TO RELATED APPLICATION

The present application claims priority to European Patent Application 23218682.5 filed on Dec. 20, 2023, the contents of which are incorporated by reference herein.

TECHNICAL FIELD

The present invention relates to the field of weft knitwear for the production of fabrics or articles that may be useful in the production of braces, bandages, socks or other. In particular, the invention refers to a knitted article, for example for making an orthopaedic brace, with a plurality of zones having different cushioning properties. The invention is also directed to a process for making a knitted article, in particular of the type mentioned above.

PRIOR ART

In the field of the joint braces and orthoses, for example knee orthoses, there are multiple types of braces as a function of the pathology and the rehabilitation path that a patient must follow to recover, if not all, at least in part, the mobility of the compromised joint.

Generally, the joint braces have a tubular body made of fabric suitably conformed to wrap the joint as a function of the rehabilitation that must be performed. The use of a fabric for making the tubular body stems from the need to provide an article with an adequate wearability and that is not uncomfortable for the patient, discouraging the use thereof.

However, the fabric tubular body alone is not sufficient to ensure the adequate fit and compression on the traumatized muscle and joint bands that need to be rehabilitated. Therefore, it is known to apply on the braces one or more functional elements that can confer greater rigidity and/or compression, such as tensioning cables, plates and/or bars made of plastic or metal.

Currently, these functional elements are applied to the textile base of the brace with subsequent application of containment pockets and/or paddings which are useful for cushioning the possible impacts, during use of the brace, of the same functional elements against the patient's soft tissues.

Such pockets and/or paddings are usually applied by means of techniques such as sewing, high-frequency welding, or other welding techniques.

The use of these techniques for making braces is not without drawbacks.

The welding of components on the textile base is usually carried out by means of high-frequency welding or heat-sealing techniques with which it is possible to couple two elements having different mechanical properties since they are made of different materials. This, therefore, involves an alteration of the mechanical behaviour of the entire brace. In addition, even if two components made of the same material are welded together, the glues or the welding films used to define the union of the aforesaid components alter the mechanical behaviour of the brace in the zones where they are applied.

Sewing external elements is an alternative technique for the application of external components to the base textile structure. In the event that the stitched components are made with a material different from that of the base textile structure, the same drawbacks described above occur, that is, also in this case the same effects of alteration of the mechanical properties of the entire brace occur. In general, the seams tend to alter the mechanical behaviour of the brace even if the same material is used to make the textile base and the components applied thereto. Finally, the seams can undergo wear and, therefore, define points of criticality and breakage that lead to a reduction in the operating life of the brace.

Document EP3480350 describes a knitted article subdivided into zones with different cushioning properties, in particular for making a sole of a footwear. In particular, the aforesaid knitted article is made as a pair of layers knitted in together, each of which is obtained by the processing of a weft thread. As a function of the cushioning that is to be conferred to a specific zone of the knitted article, the aforesaid two layers are knitted in with more or less dense meshes in such a way that a further layer interposed between them, made with the same weft thread, is more or less free to define the padding of the knitted article.

However, it is immediately apparent that the knitted article in question is not suitable to act as an orthopaedic brace, or as a similar article, as it has a high rigidity because of the presence of an intermediate layer throughout its extension. Furthermore, this also results in a higher total weight and less breathability.

SUMMARY

In this context, the technical task underlying the present invention is to propose a knitted article, in particular for an orthopaedic brace, and a process for making a knitted article that overcome the aforementioned drawbacks of the prior art.

In particular, an object of the present invention is to provide a knitted article, in particular for an orthopaedic brace, which is easily wearable by a patient and, moreover, which is comfortable and breathable once worn. In other words, it is intended to provide a knitted article that has an optimal wearability.

Another object of the present invention is to provide a knitted article, in particular for an orthopaedic brace, made by saving material without compromising the operating functionalities thereof. Therefore, specifically, the invention aims to reduce the final weight of the knitted article to increase the wearability by the user and, furthermore, to reduce its production costs.

A further object of the present invention is to provide a knitted article, in particular for an orthopaedic brace, comprising any external components applied without compromising the mechanical properties of the possible orthopaedic brace and, moreover, stably positioned on the brace.

Finally, an object of the present invention is to provide a process for making a knitted article, in particular for an orthopaedic brace, which does not provide for the application of external elements through welding and/or sewing techniques such that the final mechanical properties of the knitted article could be compromised.

In addition, the aforesaid process also aims to control with precision the positioning of any external and functional components to the brace with respect to the base structure itself of the knitted article, without altering the final mechanical behaviour.

The stated technical task and specified objects are substantially achieved by a knitted article, in particular for an orthopaedic brace, and a process for making a knitted article, which comprise the technical features disclosed in the respective independent claims.

The dependent claims correspond to further advantageous aspects of the invention. It should be appreciated that this summary introduces a selection of concepts in simplified form, which will be further elaborated on in the detailed description provided below.

The present invention concerns a knitted article, in particular for an orthopaedic brace, with a plurality of zones having different cushioning properties, including at least one flat-knitted zone and at least one padded zone.

Advantageously, the presence of padded zones and of flat-knitted zones allows the aforesaid knitted article to be used as a bandage, or as a sock, footwear or orthosis for knees or for other joints.

In particular, the aforesaid knitted article comprises a lower layer consisting of several rows of knitted stitches obtained by knitting a corresponding flat-knitted thread, an upper layer consisting of several rows of knitted stitches obtained by knitting a corresponding flat-knitted thread, a padding layer obtained by a padding yarn different from the flat-knitted thread in that it comprises at least one bundle of padding threads. In greater detail, the flat-knitted zone consists of the lower layer and of the upper layer connected to each other and, preferably, it is also devoid of the padding layer. The padded zone, on the other hand, consists of the padding layer interposed between the lower layer and the upper layer, for that the padding yarn is laid in at least one row of knitted stitches of the lower and/or upper layer.

Advantageously, making a woven fabric (i.e., the knitted article) comprising paddings integrated into the base structure itself of the woven fabric (i.e., the presence of padded zones adjacent to the flat-knitted zone) allows to provide protection zones for the patient's soft tissues on which the aforesaid knitted article will be applied.

For example, in fact, the knitted article can be configured to make an orthosis for the treatment of knee osteoarthritis wherein the padded zones offer protection to the soft tissues from contact and/or pressure exerted by rigid functional elements of the brace, such as the plates made of plastic material, the metal rods of the joints, the tensioning cable of a winder, straps, etc.

In general, the knitted article in accordance with the invention can serve as a base for different types of orthoses, for example all those orthoses that need paddings adapted to protect the soft tissues of the patients from contact and/or pressure exerted by rigid functional components of the brace in question such as the splints of a corset, the rods of a wristband, or the joints of an elbow pad.

In accordance with one aspect of the invention, each padding yarn comprises at least three bundles of padding threads.

Preferably, each bundle of padding threads can be made by the union of padding threads of different types, for example different synthetic and/or natural fibres, so as to have different elasticity and/or swelling characteristics as a function of the needs of the patient.

Even more preferably, each bundle of padding threads comprises at least three padding threads so as to combine with each other the different mechanical properties of the various types of padding threads used.

In accordance with another aspect of the invention, each thread of the bundle of padding threads is a multi-strand thread.

Preferably, each thread of the bundle of padding threads can be made by the union of different strands so as to confer to the same thread different mechanical properties (for example, in terms of elasticity or swelling) with respect to the others.

Even more preferably, each thread of a bundle of padding threads comprises at least eighteen strands.

Advantageously, therefore, the possibility of selecting threads and/or strands-both with respect to making the flat-knitted zone and the padded zone-allows to customize and adapt the final mechanical properties that the knitted article must possess in order to be optimal for the patient who will have to wear it.

In particular, the selection of the number and type of padding strands and/or of the padding threads for making the yarn of the padding layer allows making padded zones with variable shapes, thicknesses and consistency depending on the type of final padding strand used.

In accordance with one aspect of the invention, the flat-knitted thread comprises natural fibres, including wool, cotton, etc., and/or synthetic fibres including polyester, polyamide, etc.

In accordance with another aspect of the invention, the padding yarn comprises natural fibres, including wool, cotton, etc., and/or synthetic fibres including polyester, polyamide, etc.

In accordance with a further aspect of the invention, the padding yarn extends over a number of rows less than the number of rows of knitted stitches of the lower and upper layers between which it is arranged.

In other words, as already mentioned, the padded layer is present only at the padded zones and not over the entire succession of rows of knitted stitches with which the lower and upper layers were made.

In other words, the use of the padding yarn is strictly localized in the padded zones, while in the flat-knitted zones no padding yarn is present between the lower and upper layers.

In this way, the knitted article in accordance with the invention is advantageously able to guarantee a better wearability and breathability to the patient who will use it, thanks to a reduced weight and a greater flexibility. The knitted articles known to the state of the art (with which orthoses are also made) have a padding yarn also in the flat-knitted zones, increasing the rigidity and the overall weight of the knitted article itself, as well as its final cost. In fact, this excessive provision of the padding yarn implies further processing aimed at firmly constraining and squeezing the aforesaid yarn between the external layers of the brace in order to create a flat-knitted layer which, however, will have greater thickness and rigidity than that obtained with the knitted article in accordance with the invention.

In accordance with one aspect of the invention, a plurality of padding yarns is laid in at least one row of knitted stitches of the lower layer and/or of the upper layer for making the padding layer.

In accordance with a preferred aspect of the invention, the padded zone has a minimum height of 4 millimetres.

In this way, it is advantageously possible to modulate the impact cushioning properties of the knitted article as a function of the needs of the patient, thanks to the variation of the number of padding yarns laid in at least one row of knitted stitches of the lower and/or upper layers.

In accordance with another aspect of the invention, the padding layer of a first padded zone is constrained to the upper and lower layers only at at least a part of a contour perimeter delimiting the same padded zone from another padded zone and/or from one or more adjacent flat-knitted zones.

In other words, as a function of the final destination the knitted article will have—that is, whether it will be used as a bandage, or as an orthosis for a specific joint—each padded zone has a specific conformation and, therefore, a specific contour perimeter of predetermined shape. For example, a padded zone may have a circular, square, or irregular conformation.

Consequently, the padded layer is constrained to the lower and/or upper layers of a padded zone only at the contour perimeter and, therefore, at the knitting-in stitches that are made between the aforesaid lower and upper layers.

In this way, the padded zone substantially consists of a single chamber with unconstrained external layers (the lower and upper layers) and a padding yarn laid in the aforesaid two layers.

In other words, in each padded zone, the only stitches where the padding yarn is constrained to the flat-knitted threads of the lower and upper layers are the knitting-in stitches present along the contour perimeter of the padded zone itself.

Preferably, a padded layer is realised with a padding yarn arranged along a plurality of stitching rows (basically describing a serpentine), i.e. the number of rows defining the padded area. Consequently, for each stitching rows, the ends of the padding yarn are secured to stitches of the lower and/or upper layer as these stitches coincide with the aforementioned contour points of the padded area.

In the event that the knitted article is made with a numerically controlled knitting machine, these knitting-in stitches correspond to the passage of the flat-knitted threads from one needle bed to the other of the textile machine, i.e. the so-called interlacing stitches.

Advantageously, the aforesaid interlacing stitches can also be applied within the contour perimeter of a padded zone in order to vary the conformation of the padded zone itself, for example to reduce the thickness, the swelling capacity thereof and to increase the overall rigidity thereof. In other words, each padded zone can be subdivided into several mutually adjacent padded zones. These intermediate interlacing stitches, therefore, define further constraint stitches as they trace part of new contour perimeters.

Advantageously, the arrangement of these further interlacing stitches can give rise to two-dimensional figures which, depending on the distance interposed between the various stitches, give rise to a region with padding with differentiated thickness, since there is a positive correlation between distance between the interlacing stitches and the swelling capacity of the padding yarn.

Preferably, the knitted article comprises multiple padded zones arranged in a circumference direction.

In accordance with another aspect of the invention, the knitted article may comprise at least one tunnel consisting of several rows of knitted stitches obtained by knitting a further thread. In particular, each tunnel is knitted onto at least one flat-knitted zone and/or onto at least one padded zone so as to define a containment pocket to allow functional elements to pass and be kept in place.

In other words, for example in the event that the knitted article is used for making an orthosis, the tunnels are advantageously configured to allow an easy positioning of functional elements to the orthosis itself such as plates made of plastic material, metal rods of the joints, tensioning cables of a winder, straps, etc.

Even more advantageously, each padded zone associated with a tunnel allows to protect the soft tissues of the patient from contact and/or pressure exerted by the aforesaid rigid functional elements of the orthosis contained and/or guided by the tunnel.

Preferably, the further thread is a flat-knitted thread.

Alternatively, the further thread is different from a flat-knitted thread.

In accordance with a further aspect of the invention, each tunnel extends over a number of rows of knitted stitches less than the number of rows of knitted stitches of the upper layer of the padded or flat-knitted zone on which it is knitted onto.

In other words, each tunnel is preferably made only at one or more padded zones as the latter must dampen the contact and the pressure generated by the functional elements of the orthosis with the soft tissues of the patient. In other words, therefore, each tunnel defines a further layer similar to the lower and upper layers—regardless of the type used for the further thread—which is directly knitted in with the upper layer 40 of the padded zone, but not with the corresponding padded layer.

The invention also refers to a process for making a knitted article, in particular for an orthopaedic brace, with a plurality of zones having different cushioning properties, including at least one flat-knitted zone and at least one padded zone.

The aforesaid process comprises the following steps:

- knitting a flat-knitted thread over several rows of knitted stitches so as to make a lower layer;
- knitting a flat-knitted thread over several rows of knitted stitches so as to make an upper layer, wherein the flat-knitted thread of the upper layer is alternatively processed jointly with or independently of said lower layer to, respectively, make a flat-knitted zone or a padded zone;
- making a padded layer between the lower layer and the upper layer of a padded zone by laying in at least one row of knitted stitches of the lower layer and/or of the upper layer a padding yarn different from the flat-knitted thread, since it comprises at least one bundle of padding threads.

In particular, the process does not provide for arranging any padding yarn between the lower and upper layers of any flat-knitted zone.

In other words, the aforesaid process makes it possible to make a woven fabric (i.e., the knitted article) in which the flat-knitted zones and the padded zones are advantageously made with a single production step.

In other words, the padded zones are advantageously integrated during the same realization of the flat-knitted zones and, therefore, are not applied later as a patch by welding or sewing as in the prior art.

Even more advantageously, the fact that the padded zone is made starting from the same structure as a flat-knitted zone allows several functional advantages to be obtained when the knitted article is put into use:

- the mechanical behaviour of the padding in terms of elasticity and deformation is perfectly consistent with the rest of the textile structure of the knitted article, especially in the event that the latter is configured as an orthosis;
- the padded zones of the knitted article have a high degree of adaptation to the anatomical shapes of the using patients in a manner consistent with the rest of the textile structure, i.e. the flat-knitted zones, since substantially the entire padding layer is made with a yarn having mechanical characteristics consistent with the flat-knitted threads;

the constitutive nature of the padded zones does not alter the behaviour of the flat-knitted zones as the zones do not present discontinuities between them, being woven together with the structure itself.

Preferably, the process provides that each thread of the bundle of padding threads is selected from threads of the multi-strand type.

In accordance with one aspect of the invention, a plurality of padding yarns is laid in at least one row of knitted stitches of the lower layer and/or of the upper layer.

In accordance with another aspect of the invention, the padding layer of a first padded zone is constrained to the upper and lower layers only at at least a part of a contour perimeter delimiting the same padded zone from another padded zone and/or from one or more flat-knitted zones.

In accordance with a further aspect of the invention, the process also comprises a step of knitting a further thread over several rows of knitted stitches so as to make at least one tunnel. In particular, said tunnel is knitted onto at least one flat-knitted zone and/or onto at least one padded zone so as to define a containment pocket to allow functional elements to pass and be kept in place.

In this way, the aforesaid process allows to make, in a single step of production of the flat-knitted zone, also one or more hollow tunnels with integrated protection paddings. In other words, at least at the upper layers of the padded zones, corresponding tunnels configured for the insertion and positioning of functional elements, for example, for an orthosis, are made and knitted in. Conversely, at least in the sector of the orthoses, the current prior art envisages using a flat-knitted textile base with subsequent application of protective paddings and of any tunnels by means of techniques such as sewing, high-frequency welding, other generic welding techniques. However, as illustrated above, such techniques are not exempt from introducing negative effects on the elastic behaviour of the textile base.

Preferably, the further thread used for making a tunnel is a flat-knitted thread.

In accordance with one aspect of the invention, each tunnel is made with an extension of rows of knitted stitches less than the number of rows of knitted stitches of the upper layer of the padded or flat-knitted zone on which it is knitted onto.

In accordance with a preferred aspect of the invention, the process also comprises a preliminary step of setting up a numerically controlled textile machine equipped with two distinct needle beds and configured to carry out the aforementioned processing steps so as to produce a woven piece, i.e. a substantially planar knitted article, in which the padded layer is integrated between the lower and upper layers.

In this way, the process is advantageously able to allow making flat-knitted zones and/or padded zones and/or tunnels without requiring any particular modification of the production plant. The numerically controlled knitting machine, in fact, can be correctly configured to vary the activation of the needle beds that compose it and, above all, of the number of needles of the aforesaid needle beds in order to make, in succession to the flat-knitted zones, the padded zones and/or the tunnels.

In addition, the aforesaid process is also advantageously capable of making padded zones defined by a single chamber for containing the padding layer, without weaving courses completely occupied by the padding yarn and, in addition, without weaving courses completely interposed with two padded zones.

BRIEF DESCRIPTION OF THE DRAWINGS

Further features and advantages of the present invention will become more apparent from the indicative, and therefore non-limiting, description of a preferred but non-exclusive embodiment of a knitted article, in particular for an orthopaedic brace, as illustrated in the accompanying drawings in which.

With reference to the drawings, they serve solely to illustrate embodiments of the invention with the aim of better clarifying, in combination with the description, the inventive principles on which the invention is based.

DETAILED DESCRIPTION OF AT LEAST ONE EMBODIMENT

The present invention is directed to a knitted article, in particular for an orthopaedic brace, which, with reference to the figures, has been generically indicated with the number 1.

Any modifications or variants which, in the light of the description, are evident to the person skilled in the art must be considered to fall within the scope of protection established by the present invention, according to considerations of technical equivalence.

Figure 1:
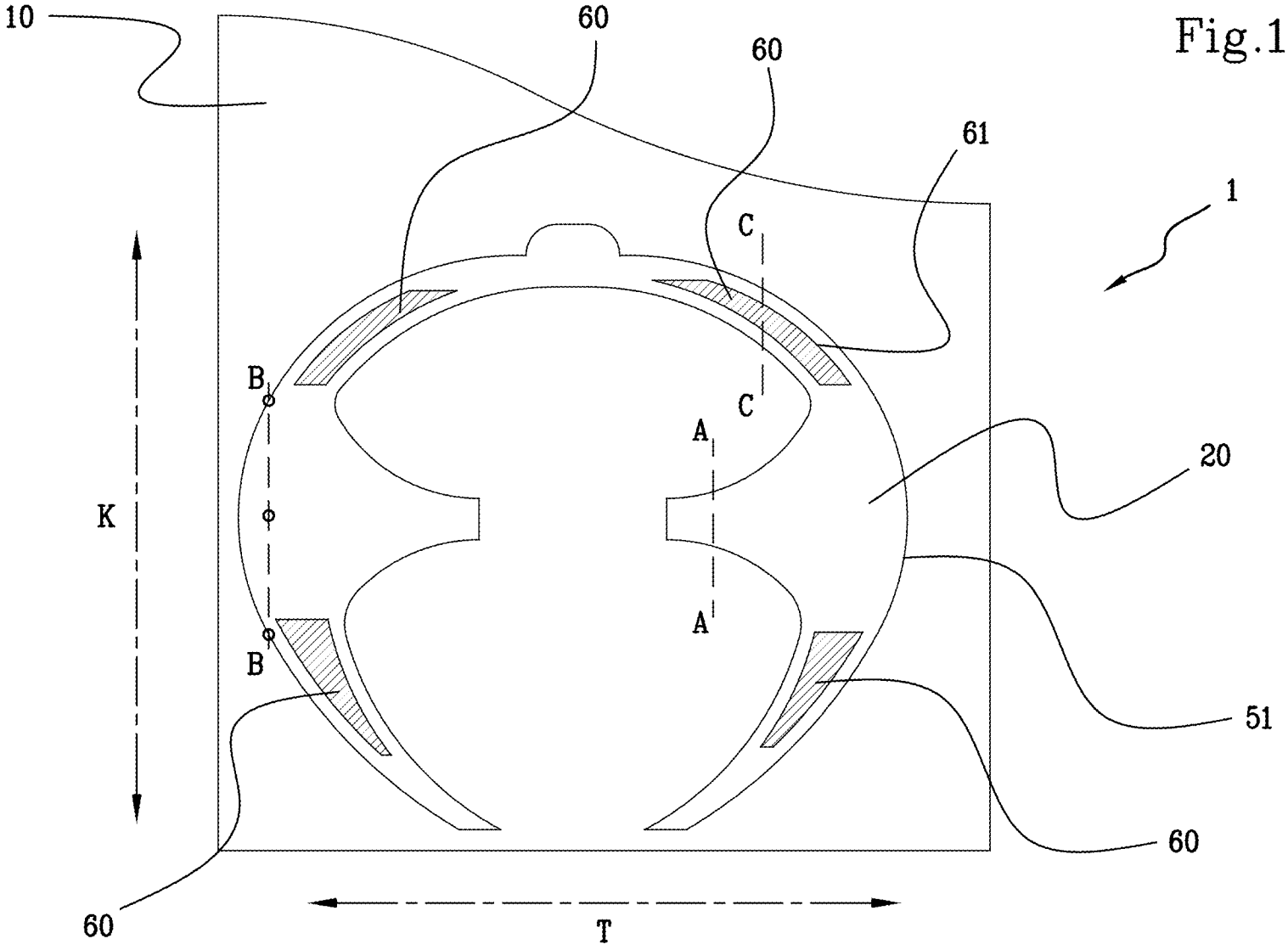
FIG. 1 illustrates, according to a schematic view, a knitted article in accordance with the present invention.

FIG. 1 schematically illustrates a knitted article 1, in particular for an orthopaedic brace, with a plurality of zones having different cushioning properties, including at least one flat-knitted zone 10 and at least one padded zone 20.

In particular, FIG. 1 shows that the knitted article has a preferably planar conformation.

Even more preferably, said knitted article 1 is made with a numerically controlled textile machine of the straight type, i.e. capable of making planar woven elements that are open along a working direction K illustrated with a specific exemplary arrow. FIG. 1 also illustrates the direction of travel of the carriage and of the thread guides of the aforesaid textile machine. This direction is indicated by the letter T and is substantially perpendicular to the aforesaid working direction K. In addition, generally, the aforesaid textile machine comprises at least two needle beds facing each other so as to make different types of knitted stitches.

Advantageously, therefore, the knitted article 1 thus obtained can maintain its substantially planar conformation to be used as a bandage, or it can be configured in a three-dimensional structure in order to make, for example, a sock, a footwear, or an orthosis for a joint such as a knee brace.

Even more advantageously, the use of the numerically controlled textile machine makes it possible to adjust the knitting-in and the arrangement of the flat-knitted threads and of the padding yarns to create contiguous differentiated zones in which zones with flat-knitted, zones with padding and zones with padding on which a tunnel has been knitted onto (the latter aspect will be better described later) can be alternated. The general shape of the knitted article 1 can therefore be generic, as can be generic the planar geometry of the padded zone 20 and the geometry of the tunnels 60, which can also be generic in shape with respect to the underlying padded zone 20.

In general, in the event that the numerically controlled textile machine is used, it is useful to say beforehand that the number of needles of each needle bed involved in the described processing and also the final number of weaving courses made is strictly dependent on the final conformation that the knitted article 1 must obtain and each flat-knitted zone 10 and/or padded zone 20 and/or tunnel 60.

Figure 2:
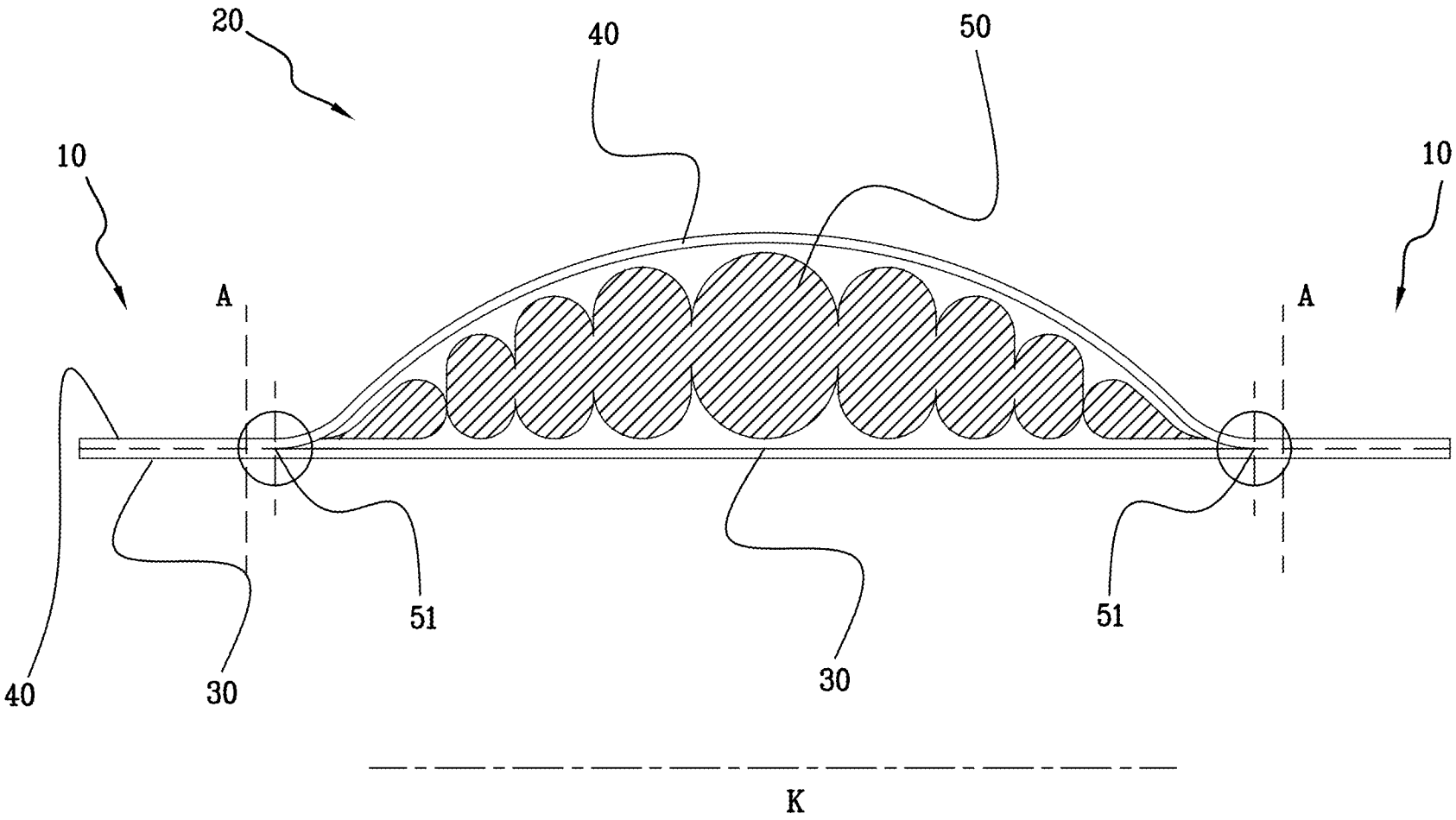
FIG. 2 illustrates, according to a side view, a first section of the knitted article of FIG. 1 along segment A-A.
Figure 3:
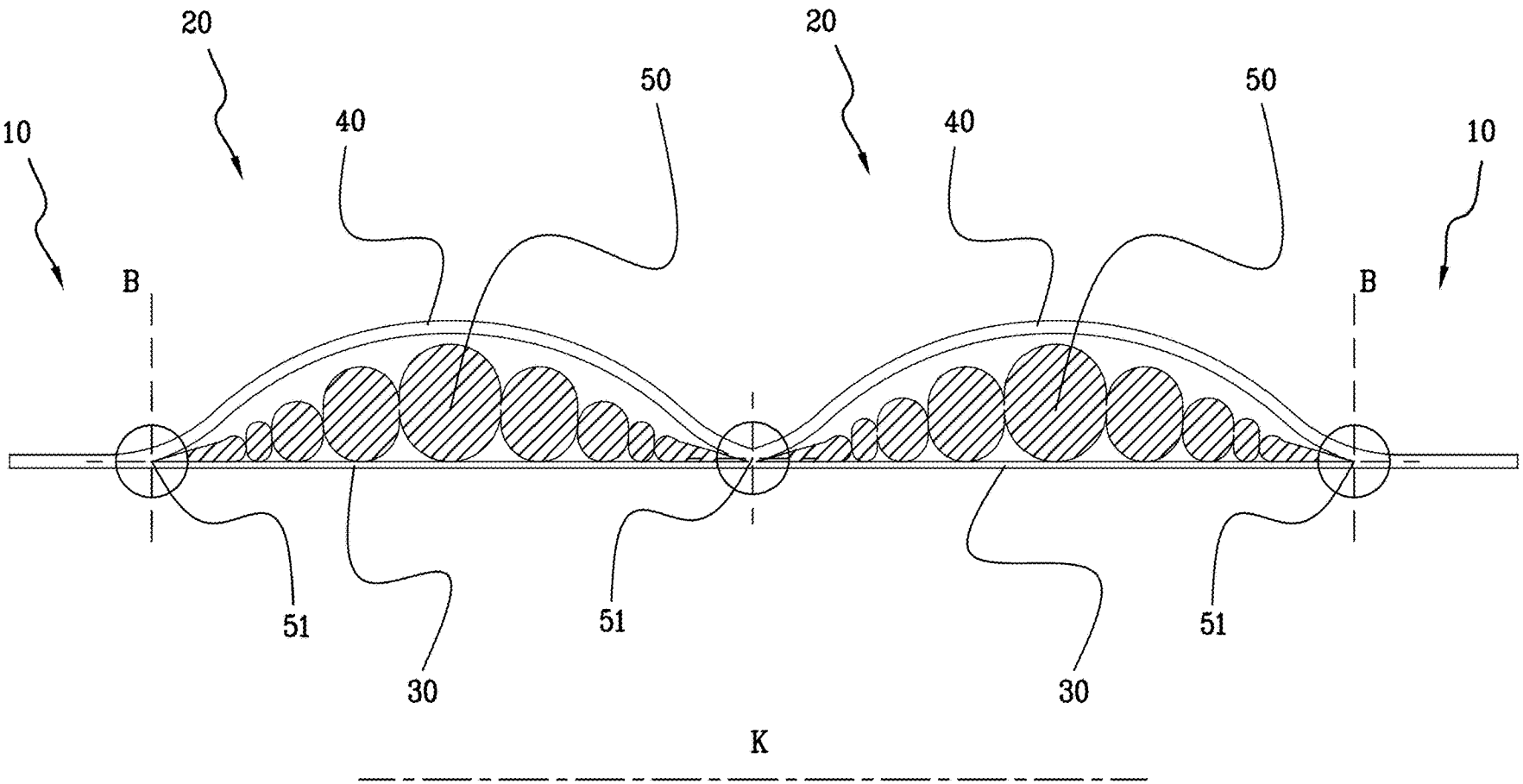
FIG. 3 illustrates, according to a side view, a second section of the knitted article of FIG. 1 along segment B-B.
Figure 4:
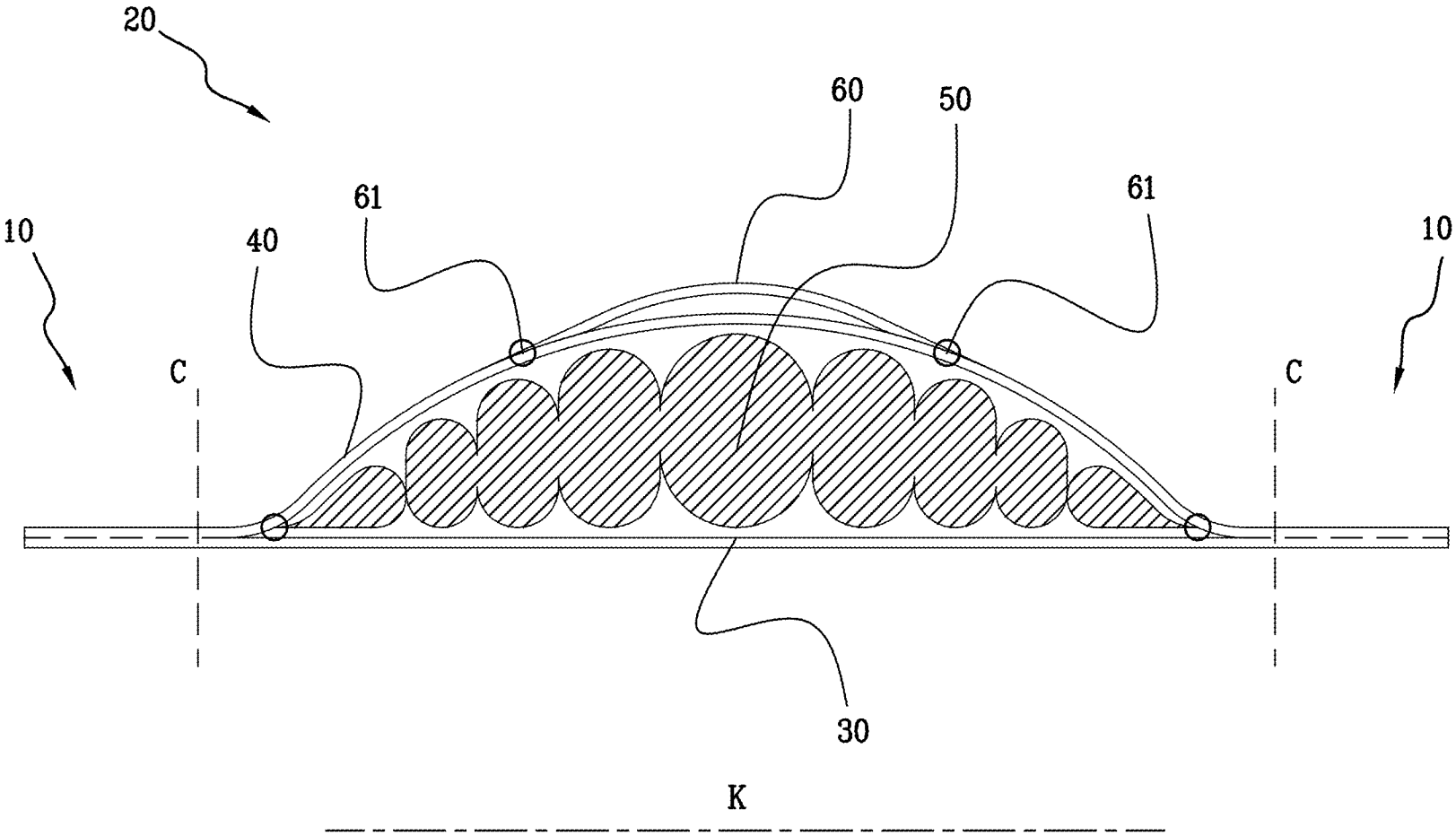
FIG. 4 illustrates, according to a side view, a third section of the knitted article of FIG. 1 along segment C-C.

FIGS. 2-4 illustrate, according to different sectional views, further detailed aspects of the aforesaid knitted article 1.

In particular, the knitted article 1 comprises a lower layer 30 consisting of several rows of knitted stitches obtained by knitting a corresponding flat-knitted thread, an upper layer 40 consisting of several rows of knitted stitches obtained by knitting a corresponding flat-knitted thread, a padding layer 50 consisting of several rows of a padding yarn different from the flat-knitted thread and comprising at least one bundle of padding threads.

The flat-knitted zone 10 consists of the lower layer 30 and of the upper layer 40 connected to each other and, preferably, it is also devoid of the padding layer 50, while the padded zone 20 consists of the interposition of the padding layer 50 between the lower layer 30 and the upper layer 40, for that the padding yarn is laid in at least one row of knitted stitches of the lower and/or upper layer.

Preferably, the padding yarn is laid into several rows of stitches, for example over ten rows, to form the padding.

The invention is also directed to a process for making a knitted article 1, in particular for an orthopaedic brace, with a plurality of zones having different cushioning properties, including at least one flat-knitted zone 10 and at least one padded zone 20.

In detail, the aforesaid process comprises the following steps:

- knitting a flat-knitted thread over several rows of knitted stitches so as to make a lower layer 30;
- knitting a flat-knitted thread over several rows of knitted stitches so as to make an upper layer 40. In particular, the flat-knitted thread of the upper layer 40 is alternatively processed jointly with or independently of the lower layer 30 to, respectively, make a flat-knitted zone 10 or a padded zone 20;
- making a padded layer 50 between the lower layer 30 and the upper layer 40 of a padded zone 20 by laying in at least one row of knitted stitches of the lower layer and/or of the upper layer a padding yarn different from the flat-knitted thread since it comprises at least one bundle of padding threads.

In particular, the process does not provide for arranging any padding yarn between the lower and upper layers 30, 40 of any flat-knitted zone 10.

In other words, for example in the event that a numerically controlled textile machine is used, the padding yarn is deposited between the lower and upper layers 30, 40 by sliding the dedicated thread guide carriage only for the fraction of the course of interest that is comprised between the interlacing stitches that delimit the corresponding padded zone 20.

A preferred aspect of the invention, both with reference to the knitted article 1 and to the process for making a knitted article 1, envisages using substantially two types of thread for making the flat-knitted zones 10 and the padded zones 20 (the tunnels 60 are preferably made with a flat-knitted thread, but they can be made with a similar thread).

Preferably, the flat-knitted thread is a thread selectable among the threads made of a material of natural origin, such as cotton, wool, etc., or among the threads made of a synthetic material, such as polyester, polyamide, etc.

Conversely, the padding yarn has instead a more complex conformation than the flat-knitted thread. The padding yarn, in fact, must have different properties and, in particular, it must ensure that it has a good swelling capacity, e.g., following a washing and drying process. The padded zone, compared to the flat-knitted zone, must have a greater thickness and a much softer consistency as the padded zone has the main function of protecting the patient's soft tissues on which the knitted article is applied. Preferably, then, the padding yarn comprises a bundle of padding threads-preferably three or more distinct bundles twisted together.

Even more preferably, each padding thread of each bundle of padding threads is of the multi-strand type.

In this way, the padding layer 50 is highly customizable as a function of the needs of the end user thanks to the possibility of selecting different strands—in terms of number and/or type—for the formation of each padding thread and, in addition, thanks to the possibility of selecting different padding threads-again in terms of number and/or type—for or the formation of the bundles of padding threads that make up the padding strand at the base of the padding layer.

In fact, the use of a bundle of multi-strand threads for making the padding yarn has an effect improving the growth of the yarn itself during the swelling phase.

Even more advantageously, in the event that a numerically controlled textile machine is used for making the knitted article 1, it is possible to adjust the knitting-in and the arrangement of the flat-knitted thread and of the padding yarn in order to create contiguous differentiated zones in which zones with or without padding yarn can be alternated, i.e. the padded zone 30 and the flat-knitted zone 20.

As anticipated, on the other hand, the further thread used to make a tunnel 60 has mechanical characteristics (such as composition, count, elasticity) similar to the flat-knitted thread used to make the flat-knitted zones 10.

FIG. 2 illustrates a first cross-section of the knitted article 1 illustrated in FIG. 1, in particular along segment A-A.

In detail, from left to right, FIG. 2 illustrates two flat-knitted zones 10 between which a padded zone 20 is interposed.

The flat-knitted zones 10 are obtained by processing only one flat-knitted thread for the lower layer 30 and a similar flat-knitted thread for the upper layer 40 alternately from the front needle bed to the rear needle bed of a textile machine. Consequently, in the flat-knitted zones 10 the lower layer 30 and the upper layer 40 are joined together. At the padded zone 20, instead, there are three contiguous layers that are not mechanically constrained:

- a lower layer 30 knitted in from the rear/front needle bed by processing a corresponding flat-knitted thread;
- the upper layer 40 knitted in from the rear/front needle bed by processing a corresponding flat-knitted thread;
- the padded layer 50 consisting of a predefined number of padding yarns arranged parallel and lying (not knitted in) between the lower and upper layers 30, 40.

In addition, FIG. 2 illustrates the interlacing stitches 51 at the passage between the flat-knitted zone 10 and the padded zone 20 and vice versa. In these stitches, the textile machine is programmed to pass the processed flat-knitted thread from the front needle bed to the rear needle bed and vice versa. As anticipated, these interlacing stitches are the only stitches capable of defining a constraint between the padding yarn and the lower and upper layers 30, 40.

FIG. 3 illustrates a second cross-section of the knitted article 1 illustrated in FIG. 1, in particular along segment B-B.

In detail, FIG. 3 illustrates two padded zones 20 adjacent to each other and interposed between two flat-knitted zones 10 having characteristics similar to those described in relation to FIG. 2.

As anticipated, the interlacing stitches 51 can also be made within the contour perimeter of a padded zone 20 so as to subdivide it into several padded zones 20. In this way, interlacing stitches can be created where the padded yarn can be constrained to the lower and upper layers 30, 40 made with flat-knitted thread. Thanks to the realization of further interlacing stitches 51 within a padded zone 20, it is therefore possible to create two-dimensional patterns/figures.

In addition, these interlacing stitches 51 made internally to the padded zone 20 allow to create zones with differentiated thickness padding, as there is a positive correlation between the distance between the interlacing stitches and the swelling capacity of the padding yarn.

FIG. 4 illustrates a third cross-section of the knitted article 1 illustrated in FIG. 1, in particular along segment C-C.

In detail, FIG. 4 illustrates a padded zone 20 interposed between two flat-knitted zones 10 and on which a tunnel 60 is knitted onto.

The flat-knitted zones 10 are made by processing a corresponding flat-knitted thread, preferably by means of a numerically controlled textile machine configured to continuously pass from the front needle bed to the rear needle bed of the machine in an alternating manner.

Unlike FIG. 2, in FIG. 4 the padded zone 20 also comprises a tunnel 60 and, therefore, four different contiguous layers can be recognized that are not mechanically constrained over their entire length:

- the lower layer 30 made with a corresponding flat-knitted thread preferably knitted in from the rear needle bed of a numerically controlled textile machine;
- the upper layer 40 made with a corresponding flat-knitted thread preferably knitted in from the front needle bed of a numerically controlled textile machine;
- the padded layer 50 consisting of a plurality of padding yarns arranged parallel and lying (not knitted in) between the aforesaid lower and upper layers 30, 40;
- the tunnel 60 preferably made with a corresponding flat-knitted thread preferably knitted in from the same front needle bed of the numerically controlled textile machine but unconstrained from the upper layer 40.

In detail, the aforesaid layers are knitted in together only at some specific connection stitches, i.e. at the interlacing stitch 51 between the flat-knitted zone 10 and the padded zone 20, and vice versa, to constrain the padding yarn to the lower and upper layers 30, 40 and, in addition, at the two knitting-in stitches of the further thread of the tunnel 60 with the upper layer 40 of the padded zone 20. These two knitting-in stitches also define the stitches that delimit the tunnel.

Preferably, as visible in FIG. 4, the tunnel 60 has an extension lower than the extension of the padded zone 20, since the padded layer has a main function of protecting the patient's skin with respect to any functional element housed in the tunnel 60 itself. Therefore, in order to be able to effectively perform the aforesaid function, the padded layer 50 must preferably exceed the extension of the tunnel 60.

Figure 5:
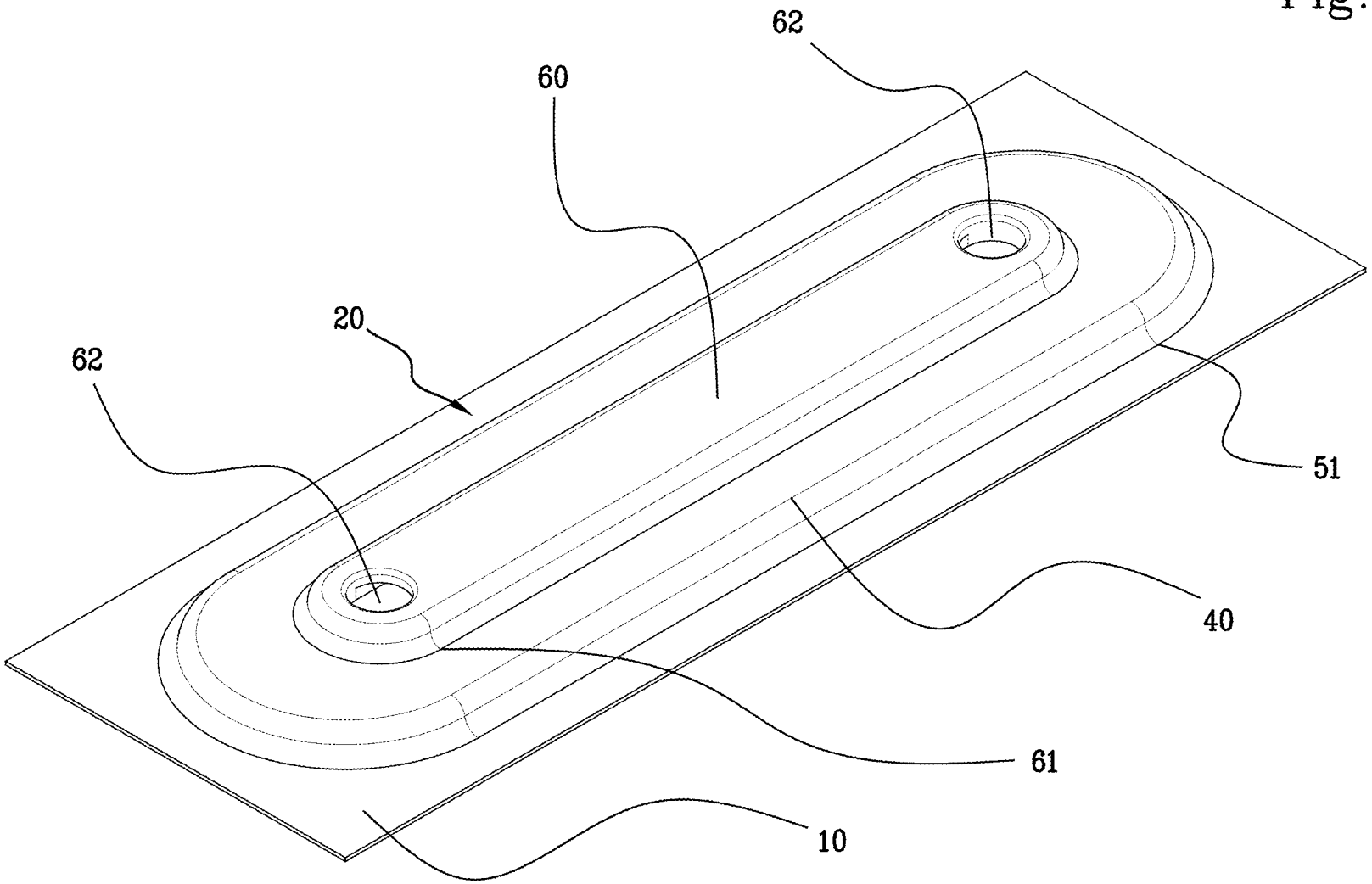
FIG. 5 illustrates, according to a perspective view, a possible conformation of a tunnel knitted in on a padded zone.

FIG. 5 illustrates a preferred embodiment of a tunnel 60 knitted in on a padded zone 20 of a knitted article 1.

In particular, this illustrated embodiment also provides for making at least one hole 62, preferably a pair of entry and exit holes 62.

The hole 62, in fact, is advantageously able to facilitate the entry and the exit of the functional elements with respect to the tunnel 60.

Advantageously, the tunnel 60 having the characteristics described above and obtained with the claimed process has a mechanical behaviour, in terms of elasticity and deformation, absolutely consistent with the rest of the structure of the knitted article 1. In this way, the tunnel 60 is able to adapt to the anatomical shapes of the patients on which the knitted article 1 is applied in a manner consistent with the rest of the textile structure. Almost the entire totality of the knitted article 1, in fact, is made of threads and yarns with mechanical characteristics comparable to each other. In addition, even more advantageously, the direct knitting-in of the tunnel 60 on the flat-knitted and/or padded zones 10, 20 does not alter the mechanical behaviour of the entire knitted article 1 as might do any elements fixed at a later time by sewing or welding, such as patches in accordance with the state of the art.

The invention claimed is:

1. A knitted article comprising an orthopaedic brace, with a plurality of zones having different cushioning properties, including at least one flat-knitted zone and at least one padded zone, comprising:

- a lower layer consisting of several rows of knitted stitches obtained by knitting a corresponding flat-knitted thread;
- an upper layer consisting of several rows of knitted stitches obtained by knitting a corresponding flat-knitted thread;
- a padding layer obtained by a padding yarn different from the flat-knitted thread, the padding yarn comprising at least one bundle of padding threads,
- wherein the flat-knitted zone consists of said lower layer and said upper layer connected to each other at ends and forming at least one pocket for the padded zone, and
- wherein the padded zone consists of the padding layer located within the pocket and interposed between the lower layer and the upper layer, for that the padding yarn is laid in at least one row of knitted stitches of the lower layer and/or of the upper layer.

2. The knitted article of claim 1, wherein said padding yarn comprises at least three bundles of padding threads.

3. The knitted article of claim 1, wherein each thread of the at least one bundle of padding threads is a multi-strand thread.

4. The knitted article of claim 1, wherein a plurality of padding yarns is laid in at least one row of knitted stitches of the lower layer and/or of the upper layer.

5. The knitted article of claim 1, wherein the flat-knitted thread comprises natural fibers.

6. The knitted article of claim 1, wherein the flat-knitted thread comprises synthetic fibers.

7. The knitted article of claim 1, wherein the padding yarn comprises natural fibres and/or synthetic fibres.

8. The knitted article of claim 1, wherein the padding yarn comprises synthetic fibers.

9. The knitted article of claim 1, wherein the padded zone has a minimum height of 4 millimetres.

10. The knitted article of claim 1, wherein the padding layer of a first padded zone is interposed between the upper layer and the lower layer only at at least a part of a contour perimeter delimiting the padded zone from another padded zone and from one or more flat-knitted zones.

11. The knitted article of claim 1, comprising at least one tunnel consisting of several rows of knitted stitches obtained by knitting a further thread, the at least one tunnel being knitted onto at least one flat-knitted zone and/or onto at least one padded zone so as to define a containment pocket to allow functional elements to pass and be kept in place.

12. The knitted article of claim 11, wherein the further thread is a flat-knitted thread.

13. The knitted article of claim 11, wherein the further thread is different from a flat-knitted thread.

14. The knitted article of claim 11, wherein each tunnel extends over a number of rows of knitted stitches less than the number of rows of knitted stitches of the upper or lower layer of the padded or flat-knitted zone on which it is knitted onto.

15. A method for making a knitted article comprising an orthopaedic brace, with a plurality of zones having different cushioning properties, including at least one flat-knitted zone and at least one padded zone, comprising the following steps:

knitting a flat-knitted thread over several rows of knitted stitches so as to make a lower layer;

knitting a flat-knitted thread over several rows of knitted stitches so as to make an upper layer, wherein the flat-knitted thread of the upper layer is alternatively processed jointly with or independently of the lower layer to, respectively, make a flat-knitted zone or a padded zone, wherein the lower layer and upper layer are knitted to form at least a pocket for the padded zone;

making a padded layer within the pocket and between the lower layer and the upper layer of a padded zone by laying in at least one row of knitted stitches of the lower layer or of the upper layer a padding yarn different from the flat-knitted thread, the padding yarn comprising at least one bundle of padding threads.

16. The method of claim 15, comprising a step of knitting a further thread over several rows of knitted stitches so as to make at least one tunnel, the at least one tunnel being knitted in on at least one flat-knitted zone and on at least one padded zone so as to define a containment pocket to allow functional elements to pass and be kept in place.

17. The method of claim 16, wherein each tunnel is made with an extension of rows of knitted stitches less than the number of rows of knitted stitches of the upper layer of the padded or flat-knitted zone on which it is knitted onto.

* * * * *